United States Patent [19]

Aitkins

[11] 4,143,933

[45] Mar. 13, 1979

[54] SAFETY SLEEVE FOR ATTACHMENT TO THE PRONG OF AN ELECTRICAL CONNECTOR AND KEY FOR ITS REMOVAL

[76] Inventor: Richard L. Aitkins, 4525 17th St., N.W., Puyallup, Wash. 98371

[21] Appl. No.: 830,571

[22] Filed: Sep. 6, 1977

[51] Int. Cl.[2] ..... H01R 13/44

[52] U.S. Cl. ..... 339/37; 339/76; 339/244 R

[58] Field of Search ..... 339/36, 37

[56] References Cited

U.S. PATENT DOCUMENTS

| | | | |
|---|---|---|---|
| 2,664,734 | 1/1954 | McEneary | 339/37 |
| 2,955,272 | 10/1960 | Gallardo | 339/37 |
| 3,345,600 | 10/1967 | Scherer | 339/37 |
| 4,030,795 | 6/1977 | Niemann | 339/37 |

FOREIGN PATENT DOCUMENTS

| | | | |
|---|---|---|---|
| 826986 | 1/1960 | United Kingdom | 339/186 R |

*Primary Examiner*—Neil Abrams
*Attorney, Agent, or Firm*—David H. Deits; Roy E. Mattern, Jr.; Ken S. Kessler

[57] ABSTRACT

A sleeve having a central channel for receiving a prong of an electrical connector and preventing use of the connector is provided. A locking stud in the form of a projection extends on a flexible arm into the channel. Upon insertion of the prong in the channel the locking stud engages a hole in the surface of the prong as is commonly provided. In one embodiment there are two such locking studs on opposite sides of the channel to engage opposite sides of the hole in the prong. The tip of the locking stud is beveled to facilitate insertion of the prong and the opposite face of the locking stud is perpendicular to the channel to prevent removal of the prong. A key having two slightly divergent blades with beveled ends is inserted in the channel. The blades slide by the end of the prong deflecting the arms and withdrawing the locking studs from the holes in the prong permitting removal of the prong. The sleeve can be constructed from two identical components. Ribs are provided in the end of the channel where the key is inserted to prevent the insertion of the prong in the wrong end. The channel is preferably larger on the end in which the key is inserted and the key is of a corresponding size so the key will not be inserted in the wrong end of the sleeve when the sleeve is not in use.

11 Claims, 4 Drawing Figures

SAFETY SLEEVE FOR ATTACHMENT TO THE PRONG OF AN ELECTRICAL CONNECTOR AND KEY FOR ITS REMOVAL

BACKGROUND OF THE INVENTION

The invention concerns a locking device for electrical plugs, The locking device attaches to the prong of a male electrical connector to prevent its insertion in a corresponding female connector and thus prevent activation of an electrical apparatus to which it may be attached.

Such devices have been previously disclosed in U.S. Pat. Nos. 2,664,734; 2,955,272; and 3,345,600.

Earlier devices have generally been too complicated or costly to effectively become utilized by the mass consumer market. The invention provides a simple and inexpensive connector lock.

SUMMARY OF THE INVENTION

A sleeve which receives and retains within a central channel through the sleeve the prong of a male electrical connector of the type having a hole in the surface of the prong. A locking stud for engagement in the hole in the prong projects into the channel. A beveled tip on a locking stud contacts the prong tip on first insertion and deflects the locking stud aside by movement of a flexible arm on which it is mounted. In a preferred embodiment there are two locking studs on opposite sides of the channel mounted on separate flexible arms. Each locking stud engages one side of the prong. The surface of the locking stud opposite the beveled surface is perpendicular to the longitudinal axis of the channel so that when the locking studs engage the hole in the prong removal of the prong is prevented.

A key is provided to permit removal of the prong from the sleeve. The key consists of a body having slightly divergent projecting blades with oppositely beveled tips. The blades are inserted in the channel and are directed alongside the prong deflecting the flexible arms outward withdrawing the locking studs from the hole in the prong. The removal of the prong from the sleeve is thus permitted.

A preferred construction of the sleeve consists of two identical halves. Each half has a central groove which form together the central channel and each has a locking stud on a flexible arm which is defined by a U shaped groove. The key and the end of the channel where it is received is preferably larger than the prong receiving end to prevent placing the key in the wrong end when the sleeve is not in use. Preferably projecting ribs extend into the key receiving end of the channel to prevent insertion of a prong in the wrong end of the sleeve.

DETAILED DESCRIPTION OF THE INVENTION

Figure 1:
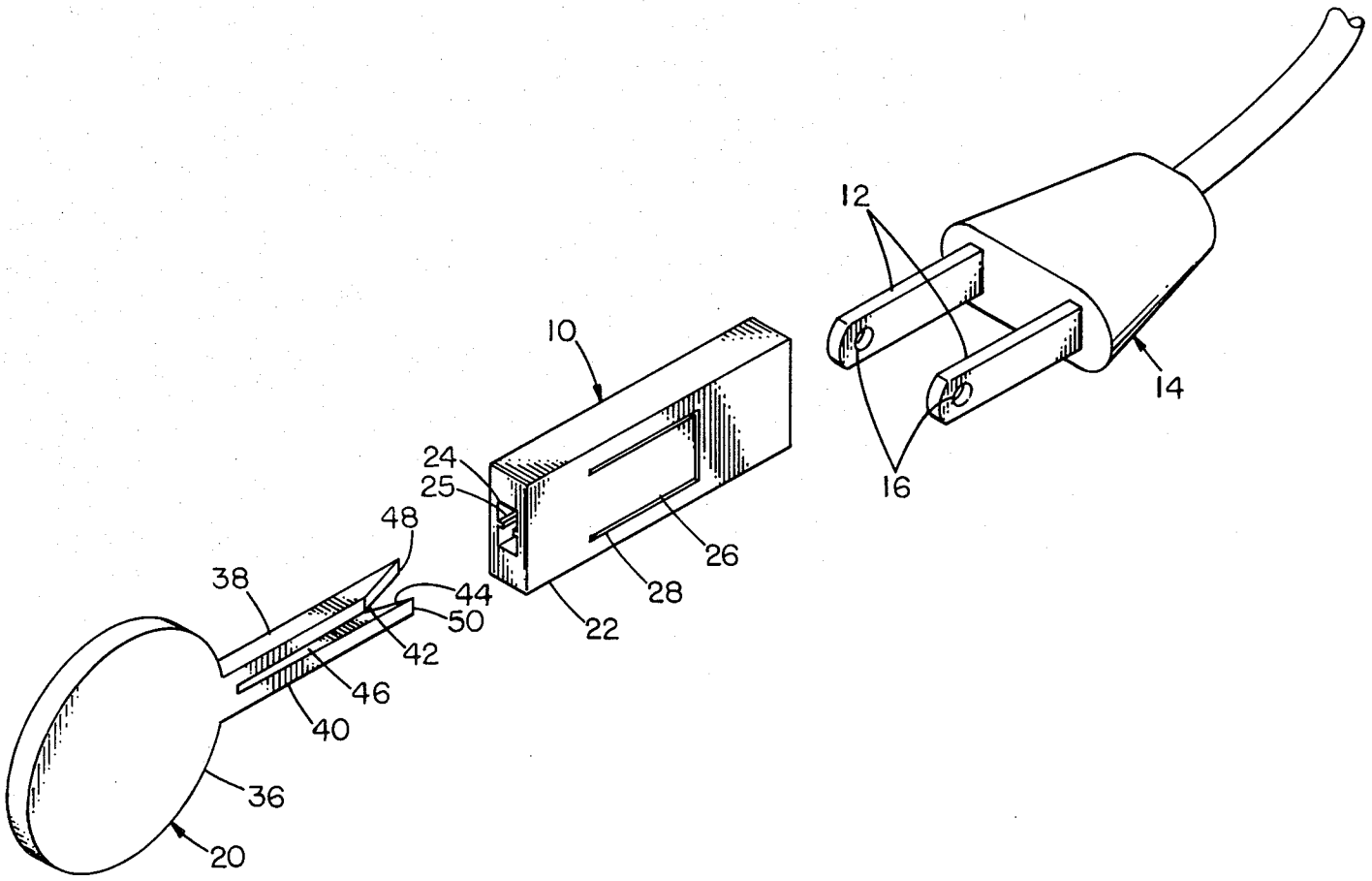
FIG. 1 is an exploded perspective view of the invention illustrating the separated positions of the key, sleeve and an electrical connector.
Figure 2:
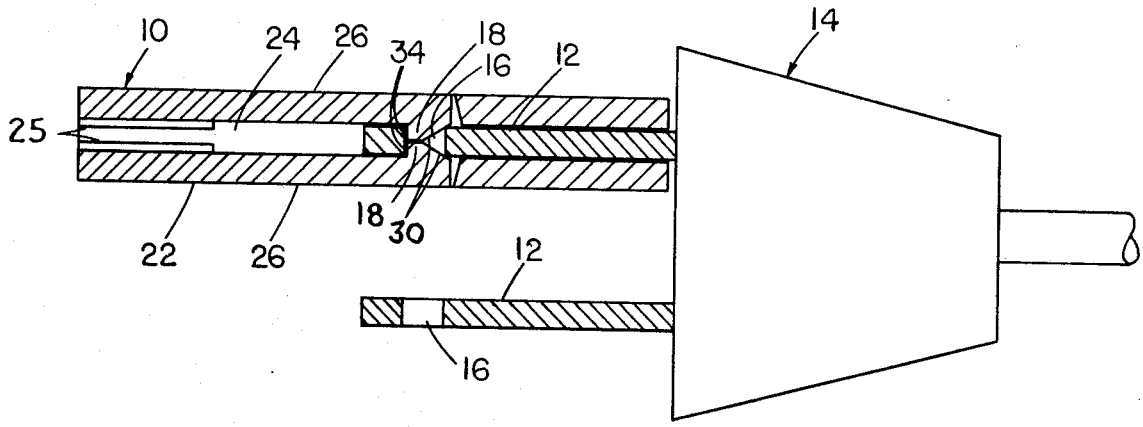
FIG. 2 is a sectional view through the sleeve and a prong of an electrical connector which is inserted in the sleeve.
Figure 3:
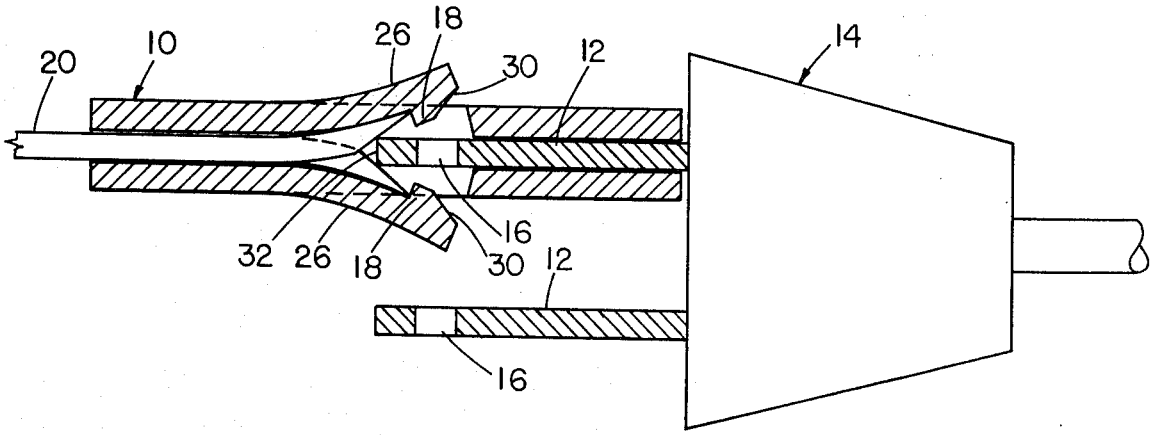
FIG. 3 is a sectional view similar to FIG. 2 with the key inserted illustrating how the flexible arms are deflected.

The preferred embodiment of the invention is illustrated in FIGS. 1 through 4. The invention is a sleeve 10 which may be attached to a prong 12 of a male electrical connector 14 of the type having a hole 16 in the surface of the prong. The sleeve 10 receives a prong of the connector and captively retains it by the engagement of locking studs 18 in the hole 16 in a manner more fully described below. This prevents the connector from being inserted in a corresponding female connector thereby preventing unauthorized and/or unsupervised use of an electrical apparatus, particularly by children. To release the prong 12 from the sleeve a key 20 is inserted in the sleeve 10. The key contacts the prong within the sleeve and, in a manner more fully described below, causes the locking studs 18 to disengage the hole 16 and permit removal of the prong from the sleeve.

The sleeve, in its preferred form, consists of a housing 22 having a central channel 24 passing centrally through it. The channel is preferably, approximately twice as long as a prong. Preferably the channel has the same transverse cross-sectional shape as a conventional prong 12. One end of the channel receives the prong and the opposite end receives the key 20. Preferably the end of the channel where the key is inserted and the key itself are slightly larger than the end where the prong is inserted so as to prevent the key from being inserted in the wrong end when the device is not in use. In the key end of the channel, preferably, there are ribs 25 extending into the channel which prevents the prong from being inserted in the wrong end. A locking stud 18 extends into the central channel. Preferably there are two such locking studs positioned on opposite sides of the channel from each other so that each may contact the prong from opposite sides. These studs are connected to the housing 22 by flexible arms 26. Preferably the arms 26, locking studs 18, and housing 22 are integrally constructed from a single piece material such as polystyrene plastic. In such a preferred construction the arms 26 are defined by a slot such as the U-shaped slots 28 shown in the drawings. The tip of the locking stud 18 is preferably beveled at 30 so that upon insertion of the prong 12 into the channel the tip 32 of the prong contacts the beveled surface 30 of the locking studs forcing the arms 26 outward allowing the prong to be inserted to a point where the locking studs engage in the holes 16 of the prong under the resilient force of the arm. The surfaces 34 of the locking studs opposite the beveled surface prevent removal of the prong and are preferably perpendicular to the longitudinal axis of the channel. Further travel of the prong inward is limited by the body of the plug 14 contacting the end of the housing 22. The sleeve 10 thus captively holds the prong preventing its removal and insertion of the plug into a female receptacle.

The key 20 is provided to release the prong from the sleeve 10. The key consists of a body 36 which provides a convenient means of grasping it and blades 38 and 40 which each act upon a corresponding arm and locking stud. In the preferred embodiment there are thus two such blades which pass on opposite sides of the ribs 25. The blades 38 and 40 have tips 42 and 44 respectively which are oppositely beveled. They are preferably beveled at ten (10) degrees. When the blades are inserted in the channel 24 when the sleeve 10 is holding a prong, the beveled ends 42 and 44 contact opposite edges of the prong tip 32. As the key 20 is inserted further the blades are deflected outward against their corresponding arms 26 drawing the locking studs 18 from the hole 16 in the prong and permitting removal of the prong from the sleeve 10. Preferably the blades 38 and 40 are angled from each other by approximately two (2) degrees at 46. This causes the blade tips 48 and 50 to travel along the walls 52 of the channel 24 during insertion and to be directed alongside rather than into the tip 32 of the prong.

Figure 4:
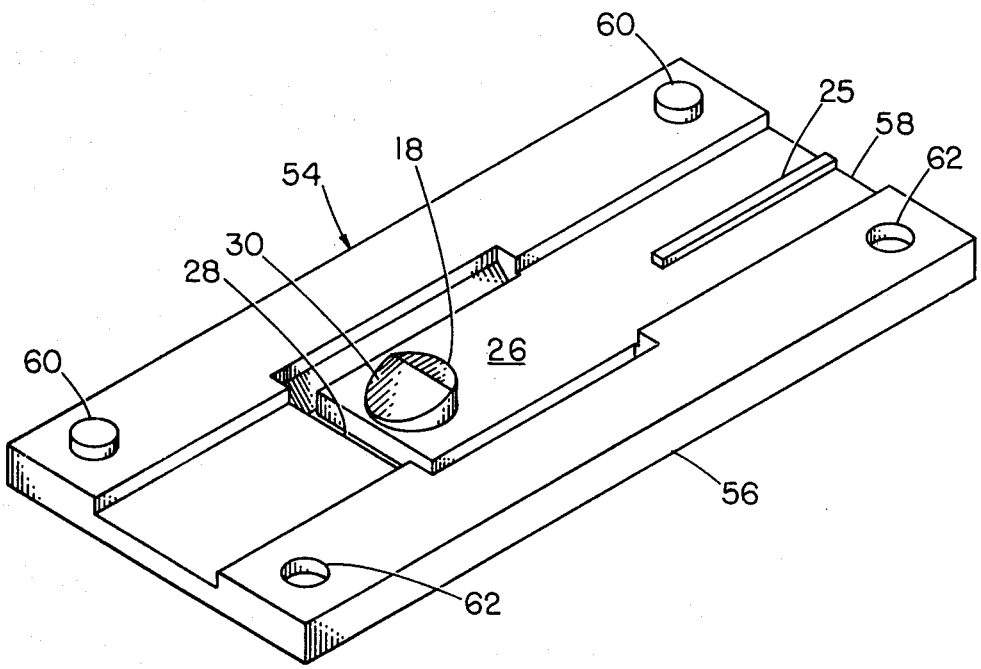
FIG. 4 is a perspective view of a component of the sleeve which when mated with an identical component form a complete sleeve.

Preferably the sleeve is constructed of components such as the component 54 shown in FIG. 4. The component consists of a body 56, preferably of a generally rectangular shape, of a semi-rigid material. A central groove 58 extends the length of the body and a U shaped slot 28 as previously described above outlines and defines the flexible arm 26 as also described above to which the locking stud 18 having the beveled tip 30 is attached. Preferably the component 54 is provided with indexing elements such as the pins 60 and receiving holes 62 as illustrated in FIG. 4. When such a construction is used a sleeve 10 can be constructed from two identical components 54. The indexing pins 60 fit into the receiving holes in the mating component and vice versa. The two halves may be held together with a suitable adhesive.

The sleeve and key together provide a very simply constructed and effective safety device. The key and the sleeve can be molded from an inexpensive and easy to handle plastic material to provide a simple, effective safety device.

I claim:

1. A sleeve for attachment to a prong of a male electrical connector of the type having a hole in the surface of the prong to prevent insertion of the connector in a female connector comprising:

(a) a housing having a central channel communicating with either end of the housing permitting the insertion of the prong in one end and a key in the opposite end;

(b) a first flexible arm connected to the housing;

(c) a first locking stud attached to the first flexible arm which projects centrally into the channel for engagement in the hole in the prong upon its insertion;

(d) a second flexible arm connected to the housing; and (e) a second locking stud attached to the second flexible arm which projects centrally into the channel opposite from the first locking stud so that the locking studs each engage opposite sides of the hole in the prong upon its insertion and so that the prong is secured in the sleeve until a key is inserted in the channel permitting its removal.

2. A sleeve for attachment to a prong of a male electrical connector, as claimed in claim 1, wherein the first locking stud has a beveled tip to permit the easy insertion of the prong.

3. A sleeve for attachment to a prong of a male electrical connector, as claimed in claim 2, wherein the first locking stud has a surface opposite the beveled tip which is perpendicular to the longitudinal axis of the channel to prevent removal of the inserted prong.

4. A sleeve for attachment to a prong of a male electrical connector, as claimed in claim 1 wherein the housing has a pair of slots in opposite sides of the channel defining the flexible arms.

5. A sleeve for attachment to a prong of a male electrical connector, as claimed in claim 1, and a key for permitting removal of the sleeve from the prong, comprising; a key having a body and a pair of adjacent blades for insertion in the channel in the sleeve each having a tip beveled in a direction opposite the adjacent blade so that the blades contact the end of the prong and are deflected against the arms forcing the locking studs out of the hole in the prong.

6. A sleeve for attachment to a prong of a male electrical connector and key for permitting removal of the sleeve from the prong, as claimed in claim 5, wherein the blade arms are angled so that the blade tips are made to contact opposite interior walls of the channel upon insertion so that the beveled tips are directed to either side of the end of the prong.

7. A sleeve for attachment to a prong of a male electrical connector and key for permitting removal of the sleeve from the prong, as claimed in claim 6, wherein the blades are angled approximately two (2) degrees from each other.

8. A sleeve for attachment to a prong of a male electrical connector and key for permitting removal of the sleeve from the prong, as claimed in claim 5, wherein the channel is larger on one end where the key is received and wherein the key blades are of a correspondingly larger size so that the key cannot be inserted in the opposite end where the prong is to be inserted.

9. A sleeve for attachment to a prong of a male electrical connector, as claimed in claim 1, wherein the housing includes a rib extending into one end of the channel to prevent the insertion of the prong in the end containing the rib.

10. A component of a sleeve for attachment to a prong of a male electrical connector of the type having a hole in the surface of the prong to prevent insertion of the connector in a female connector, comprising: a body of a semi-rigid material having a central groove extending the length of the body, a U shaped slot defining a flexible arm adjacent the groove, a locking stud having a beveled tip on the flexible arm projecting into the groove to contact the hole in the prong, and means for indexing the component so that when the component is placed adjacent a similarly constructed component a sleeve is formed having a central channel defined by the grooves in the components and the locking studs engage opposite sides of an inserted prong.

11. A component of a sleeve for attachment to a prong of a male electrical connector, as claimed in claim 10, wherein the indexing means comprises a plurality of holes on one side of the body and a plurality of projections on the opposite side of the body.

* * * * *